US006757399B1

(12) United States Patent
Cheng

(10) Patent No.: US 6,757,399 B1
(45) Date of Patent: Jun. 29, 2004

(54) ANTI-NOISE-ELECTRET PICK-UP WITH AN ELECTRET

(76) Inventor: Ziyi Cheng, No. 501 Unit, Building 4, Fenghe Dong Yuan Baidi Road, Nankai District, Tianjing (CN)

( * ) Notice: Subject to any disclaimer, the term of this patent is extended or adjusted under 35 U.S.C. 154(b) by 0 days.

(21) Appl. No.: 09/509,293

(22) PCT Filed: Jul. 21, 1999

(86) PCT No.: PCT/CN99/00097

§ 371 (c)(1),
(2), (4) Date: Jun. 15, 2000

(87) PCT Pub. No.: WO00/05922

PCT Pub. Date: Feb. 3, 2000

(30) Foreign Application Priority Data

Jul. 22, 1998 (CN) ..... 98207092 U

(51) Int. Cl.[7] ..... H04R 25/00
(52) U.S. Cl. ..... 381/356; 381/174
(58) Field of Search ..... 381/355–358, 381/173–174, 191

(56) References Cited

U.S. PATENT DOCUMENTS 3,896,274 A * 7/1975 Fraim et al. ..... 381/191
3,944,756 A * 3/1976 Lininger ..... 381/355
4,268,725 A * 5/1981 Nakagawa et al. ..... 381/174
4,281,222 A * 7/1981 Nakagawa et al. ..... 381/357
4,321,432 A * 3/1982 Matsutani et al. ..... 381/174
4,685,137 A * 8/1987 Watson et al. ..... 381/174
5,101,543 A * 4/1992 Cote et al. ..... 29/25.41

* cited by examiner

*Primary Examiner*—Curtis Kuntz
*Assistant Examiner*—P. Dabney

(57) ABSTRACT

A noise canceling pickup with an electret is provided with a cylinder body having a front cover and a rear cover, said front cover is provided with sound passing holes, said cylinder body is provided with an oscillating membrane of the electret, a back electrode sheet and a back electrode base, wherein said cylinder body is composed of a front cylinder body and a rear cylinder body, said oscillating membrane is provided into said front cylinder body, said rear cover of said cylinder body is provided with at least one sound passing hole, and said rear cover is provided with electric elements therein. With the arrangement according to the present invention, the distance between the opposite front and rear sound passing holes can be made smaller. The noise canceling pickup with an electret, can be used in the higher frequency band and in a wide frequency range to cancel the noises more effectively.

11 Claims, 10 Drawing Sheets

ANTI-NOISE-ELECTRET PICK-UP WITH AN ELECTRET

FIELD OF THE INVENTION

The present invention relates to a noise-canceling pickup with an electret. Especially, the present invention relates to the first-order pressure gradient air-conduction noise canceling pickup with only one electret, in which the distance between the opposite front and rear sound passing holes can be made smaller.

BACKGROUND OF THE INVENTION

As those skilled in the art know, there are many conventional the first-order or the second-order pressure gradient air-conduction noise canceling pickups with the so called heart shape directional performance (cardioid microphone) or figure "8" type directional performance (bidirectional microphone). In the prior art, different pickups have different performances. Nevertheless, the moving-coil or the electromagnetic-type air-conduction noise canceling pickups have a relatively low sensitivity. The only way to obtain the required sound pressure is to increase the distance between the opposite front and rear sound passing holes, resulting in the distance between the opposite front and rear sound passing holes becoming too long. Furthermore, although the distance between the opposite front and rear sound passing holes can be made smaller, such as a few millimeters, with benefits that the higher sensitivity is realized for the conventional noise-canceling pickup with the electret, the distance between the opposite front and rear sound passing holes can not be made more smaller with the limit of the inner structure of the pickup. Even the desired specifications of a single pickup are realized according to the test results, when the pickup is inserted into its housing to be used as a practical microphone, the distance between the opposite front and rear sound passing holes of the microphone cylinder becomes longer, resulting in a much lower effect to cancel the noises. Especially, the effect to cancel the noises becomes much poor in the higher frequency band. With this reason, the conventional noise-canceling microphone can only be used in the case of the ambient noise being relatively low and being in the lower frequency band. In this case, the output voice is not clear enough, and the noise can not be canceled totally. As the signal-noise ratio between the practical ambient noise and the voice source is relatively low, the ambient noise usually interferes the voice output from the voice source.

In the conventional noise canceling pickups, a sound filtering layer is additionally provided on the outer surface of the end of the pickups for receiving voice from the main voice source, in order to lower the influence to the voice receiving effect of the pickups by the speaker when he/she is speaking and breathing. However, the sound filtering layer has a certain thickness, so that when mounted into the housing, the distance between the opposite front and rear sound passing holes has to be further lengthened, resulting in a much lower effect to cancel the noises. Moreover, if the pickup is not provided any outer housing of the microphone, as the sound filtering layer is made of loose material, the sound filtering layer is very easy to be damaged. The preferred structure of the noise canceling pickup is that the acoustic arrangements/performances on the two sides of the oscillating membrane are substantially symmetrical to each other. However, as the membrane tightening ring is an essential member and must be used, it is very difficult to provide a noise canceling pickup whose acoustic arrangements/performances on the two sides of the oscillating membrane are substantially symmetrical to each other.

Moreover, in the case of the voice being identified by the computer, the voice input work must be done in the special language laboratory. When used in the communication device, the only way used to cancel the noise is to make the sensitive low. Therefore, it is absolutely necessary to provide a noise canceling pickup with an electret which can cancel the noises even in the higher frequency band.

SUMMARY OF THE INVENTION

To overcome the drawbacks mentioned above, the object of the present invention is to provide a noise canceling pickup with an electret, which can be used in the higher frequency band and in a wide frequency range to cancel the noises more effectively.

According to the present invention, a noise canceling pickup with an electret is provided with a cylinder body having a front cover and a rear cover, said front cover is provided with sound passing holes, said cylinder body is provided with an oscillating membrane of the electret, a back electrode sheet and a back electrode base, wherein said cylinder body is composed of a front cylinder body and a rear cylinder body, said oscillating membrane is provided into said front cylinder body, said rear cover of said cylinder body is provided with at least one sound passing hole, and said rear cover is provided with electric elements therein.

With the arrangement according to the present invention, the distance between the opposite front and rear sound passing holes becomes shortened, therefore, a good effect of noise canceling with directional performance can be obtained, a higher signal-noise ratio can be realized, and the noise canceling pickup with an electret can be mounted onto its external supports without the outer shell.

Preferably, the membrane tightening ring is provided to abut against the oscillating membrane so as to adjust the position of the oscillating membrane.

Preferably, a damping membrane is provided within said front cylinder body to abut against the front cover thereof, said damping membrane is fixed by a damping membrane pressing sheet, and another damping membrane is provided within said front cylinder body to abut against the rear cover wall thereof.

Preferably, said damping membrane is arranged in the middle position of said front cylinder body.

Preferably, said damping membrane is arranged within said front cylinder body to abut against the rear cover wall thereof.

Preferably, the cross section of said rear cylinder body is different to that of said front cylinder body, and the connection portion between the rear cylinder body and the front cylinder body is formed so as to not prevent the sound wave from entering the rear wall sound passing holes of the front cylinder body.

Preferably, said rear cylinder body is connected to the back surface or side surface of said front cylinder body.

Preferably, said rear cylinder body is combined with a front body and a rear body, and a certain angle is arranged between the orientation of said front body and that of said rear body.

Preferably, said back electrode is output from a side wall of said front cylinder body.

Preferably, further comprising a fixing in place means which is provided on said rear cylinder body.

Preferably, said front cylinder body is provided with a partition washer which is in engagement with the damping membrane pressing sheet, a side-front washer which is in engagement with the membrane tightening ring, and a partition which is convex in the central portion thereof and is provided between said partition washer and said side-front washer, said central portion of the partition is arranged to convex to the oscillating membrane and to be projected into the membrane tightening ring, so as to form a chamber together with the oscillating membrane, and the outer surface of said convex portion is arranged to abut against the inner surface of said side-front washer and the inner surface of said membrane tightening ring.

Preferably, said front cylinder body is provided with a side-front washer which is in engagement with the membrane tightening ring, and a membrane tightening ring which is arranged between and is in engagement with said side-front washer and the oscillating membrane, wherein the membrane tightening ring is provided with a concave portion in the central portion thereof, and a chamber is formed between the concave portion and the oscillating membrane.

In a word, with the arrangement according to the present invention, the distance between the opposite front and rear sound passing holes becomes shortened, therefore, a good effect of noise canceling with the so called heart shape directional performance or figure "8" type directional performance can be realized, a higher signal-noise ratio can be obtained, and the noise canceling pickup with an electret can be mounted onto its external supports without the outer shell.

Above and further objects and advantages will be more easily understood from the following detailed description of the preferred embodiments taken together with the accompany drawings.

BRIEF DESCRIPTION OF THE ACCOMPANY DRAWINGS

The preferred embodiments of the present invention will be described in detail according to the accompany drawings.

The First Embodiment

Figure 1:
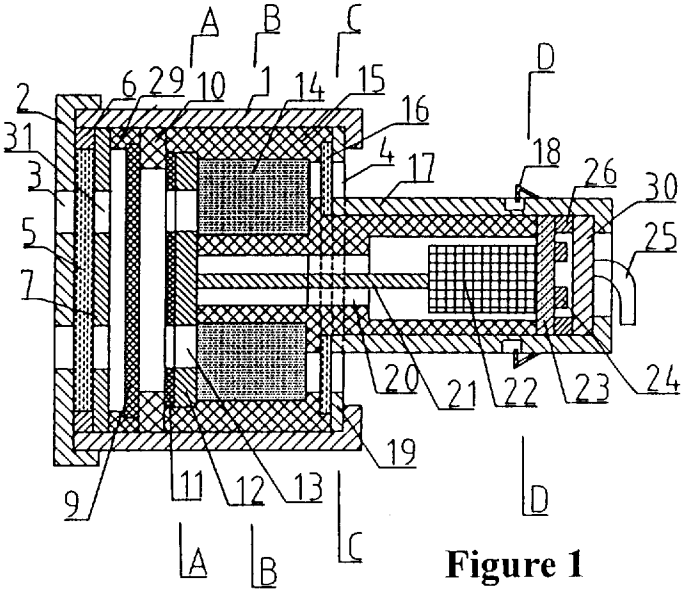
FIG. 1 is a cross section view of the noise-canceling pickup according to the first embodiment of the present invention.
Figure 1A:
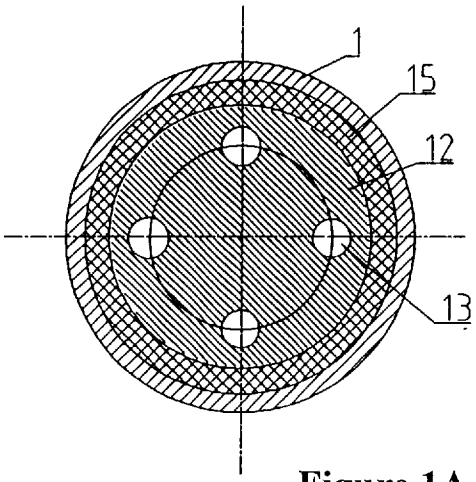
FIGS. 1A to 1D are the cross section views in lines A—A, B—B, C—C, and D—D as shown in FIG. 1, respectively.

Reference is at first made to FIG. 1 which is a cross section view of the noise-canceling pickup according to the present invention, wherein the oscillating membrane is located near the front cover of the front cylinder body. According to the present embodiment, the noise-canceling pickup according to the present invention is provided with a cylinder shell which is composed of a front cylinder body 1 and a rear cylinder body 17. The front cylinder body 1 is provided with a front cover 2 at the front end thereof, and is further provided with a rear cover 19 which is located on the connect portion between the front cylinder body 1 and the rear cylinder body 17. The shell can be formed as any suitable shape according to the practical needs. The outer diameter of the shell can be determined in a range of 3 to 55 mm and the height of the shell in a range of 3 to 20 mm by means of the experiment method. The front cover 2 of the shell is provided with one or more front cover sound passing holes 3. A damping membrane ring 6 is provided to abut against the inner surface of the front cylinder body 1 and to be located just behind the front cover 2. A damping membrane pressing sheet 7 is provided to urge the damping membrane ring 6 to abut against the front cover 2, so as to form a chamber into which a damping membrane 5 is provided. A oscillating membrane 9 is located away from the back surface of the damping membrane pressing sheet 7 by inserting a membrane tightening ring 8 between the oscillating membrane 9 and the damping membrane pressing sheet 7, the membrane tightening ring 8 is provided to abut against the inner surface of the front cylinder body 1. In this way, the damping membrane pressing sheet 7, the membrane tightening ring 8 and the oscillating membrane 9 are assembled together to form another chamber. In this case, the sound wave can pass through the front cover sound passing holes 3, the damping membrane 5, the damping membrane ring 6, the damping membrane pressing sheet 7 and the another chamber, successively, and impact on the oscillating membrane 9 from the front surface thereof. On the other hand, one or more rear wall sound passing holes 4 of the front cylinder body 1 is provided on the rear end of the front cylinder body 1 where the front cylinder body 1 is connected to the rear cylinder body 17. In this case, the sound wave can pass through the rear wall sound passing holes 4 of the front cylinder body 1, then pass through the damping membrane 16 which is located between a back electrode base 15 and the rear wall of the front cylinder body 1, then reach a sound space 14 of the back electrode base 15, then pass through back electrode holes 13 provided on the back electrode sheet 12, then reach a chamber provided between the back electrode sheet 12 and the oscillating membrane 9 and kept away from each other by means of inserting a spacing washer 10 therebetween, and impact on the oscillating membrane 9 from the back surface thereof. In this way, the ambient noise can be cancelled, the so called figure "8" type directional performance or heart shape directional performance can be realized. Moreover, the sound space 14 of the back electrode base can be formed as a through hole.

Compared with the noise-canceling pickup in the prior art, the noise-canceling pickup according to the present invention is additionally provided with the front damping membrane 5, the rear damping membrane 16, the rear cylinder body 17 and a fixing in place means 18, except which the operation procedure, the structure, the used materials, and the designed circuits are all the same as those in the prior art. Therefore, the description thereof is omitted.

The rear cylinder body 17 can be formed as a regular shape, such as a square, a rectangle, a circle, a triangle, a rhombus, a polygon, a fan-shape, or an oval-shape, etc. The rear cylinder body 17 can also be formed as a non-regular shape deformed from a square, a rectangle, a circle, a triangle, a rhombus, a polygon, a fan-shape, or an oval-shape, etc. Further, the rear cylinder body 17 can be formed as a complex shape combined from a few shapes of a square, a rectangle, a circle, a triangle, a rhombus, a polygon, a fan-shape, or an oval-shape, etc. That is to say, the rear cylinder body 17 can be formed as a uniform shape or a complex shape combined from some regular shapes. Moreover, the rear cylinder body 17 can be formed as a straight one or a curve one. The length and the width of the rear cylinder body 17 can be selected in a range of 0.2 to 50 mm, preferably in a range of 1 to 30 mm, as the practical needs. The distance between the rear wall sound passing holes 4 of the front cylinder body and the back surface of the back electrode sheet 12 can be selected in a range of 0 to 11 mm, preferably in a range of 1 to 5 mm, determined by means of experiments according to the practical needs. In order to realize the so called heart shape directional performance, the sound space 14 of the back electrode base can be filled with a damping material by which the propagation velocity of the sound wave can be regulated, so as to make the sound wave input from the front sound passing holes can reach the oscillating membrane 9 at the same time when the sound wave input from the rear sound passing holes reaches the oscillating membrane 9. In this way, the sound wave input from the front sound passing holes and the sound wave input from the rear sound passing holes can be counteract in a corresponding manner, so as to cancel the ambient noise. On the other hand, in order to realize the so called figure "8" shape directional performance, the damping material (damping material A) is not necessary to be filled with to low down the propagation velocity of the sound wave. The type and amount of the damping material A can be determined by means of experiments according to the practical needs. As mentioned above, in the way from the rear wall sound passing holes 4 of the front cylinder body to the sound space 14 of the back electrode base can be provided with the rear damping membrane 16. The damping membranes 5 and 16 (damping material B) can be made of the felt or non-woven fabric, etc. The damping membranes 5 and 16 are provided in order to cancel the noise which would be occurred on the oscillating membrane resulted from the gas output from the user's mouth during his/her breath when using the pickup. The used material and the operation process of the damping membranes 5 and 16 are the same as the used material and the operation process of those provided on the front surface of the sound passing holes located on the shell of the conventional pickup. In the case of using the noise-canceling pickup according to the present invention alone, i.e., not inserting the same into a microphone housing, the noise-canceling pickup according to the present invention can be provided within its own shell to prevent the oscillating membrane from being damaged and prevent the performance of the pickup from becoming bad. The damping membrane 5 can be made of the damping materials, such as a damping felt or a damping non-woven fabric, etc. Whether the damping membrane 5, the damping membrane 16, the damping membrane ring 6, and the damping membrane pressing sheet 7 are used or not can be determined according to the practical needs. Further, If the pickup is provided within the microphone shell, the damping membrane is not necessary to be provided within the pickup. If the shell are not provided to cover the pickup so as to use the noise-canceling pickup according to the present invention independently, whether the damping membrane is provided within the pickup can be determined according to the practical needs. The back electrode base 15 is made of such materials as insulation materials.

Figure 1D:
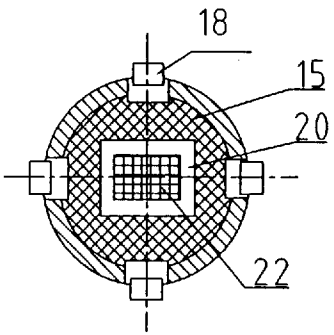
Figure 1C:
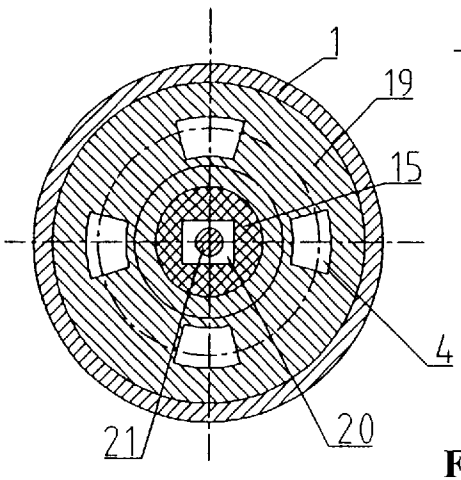
Figure 1B:
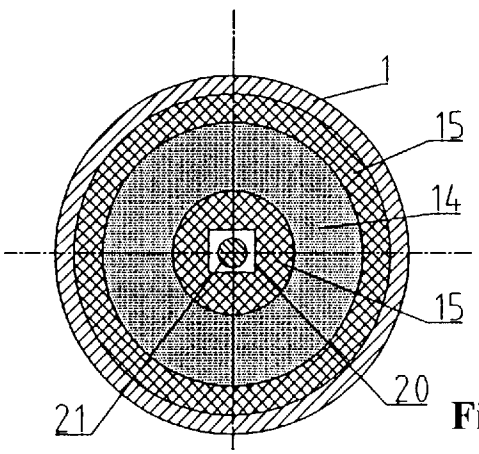

It can be noted that only necessary parts to receive voice are provided into the front cylinder body of the noise-canceling pickup according to the present invention, on the other hand, the other unnecessary parts, such as the combined field-effect tube 22, the printed circuit board 23, and the wiring electrode 24, are provided into the rear cylinder body. In this way, the distance between the front sound passing holes which is oriented to the voice source and the rear sound passing holes which is directed in the opposite direction can be made as near as possible according to the practical needs. Therefore, even the pickup is further provided with an outer shell, a higher capacity for canceling the noise can be also obtained at the higher frequency band. Moreover, the rear cylinder body can also directly be used as a connection part with the support of the microphone, so that the outer shell of the microphone can be omitted. In such a position on the outer surface of the rear cylinder body 17 as not making the noise canceling performance bad or not adversely affecting the so called heart shape directional performance or figure "8" type directional performance, can be provided with a fixing in place means 18, so as to more reliably mount the pickup on its support to prevent it from being disengaged with the support. That is to say, according to the practical needs, the fixing in place means 18 can be provided on any position on the rear cylinder body 17 between the rear cover of the rear cylinder body 17 and a section thereof which is a certain distance such as 2 mm away from the rear surface of he rear wall sound passing holes 4 of the front cylinder body. The fixing in place means 18 can be formed as being concave or convex from the rear cylinder body, so as to be mounted on the support of the pickup. As shown in FIGS. 1 and 1D, the fixing in place means 18 is in the shape of an up side down triangle. The fixing in place means 18 can be connected to or integrally provided on the outer shell of the pickup. A back electrode connecting sheet 12 and a back electrode 21 of a pin of the combined field-effect tube 22 are provided within a back electrode passing hole 20 of the back electrode base 15. The combined field-effect tube 22 is mounted on the printed circuit board 23, being electrically connected to an external circuit by means of the pins 24 of the printed circuit board 23. The extending wire 25 can also be led outside from the wall of rear cover 19 or the rear cylinder body 17. The circuit can also be provided on the other place outside of the pickup instead of being provided within the front or rear cylinder bodies. The rear cylinder body 17 can be formed as a cylinder shape or the other shapes. The diameter or the section dimensions of the front cylinder body 1 can longer than, equal to, or shorter than the diameter of the pickup. That is to say, the diameter of the front cylinder body 1 can not equal to the diameter of the pickup. However, the diameter of the root portion of the rear cylinder body 17, i.e., the diameter of the connection portion between the rear cylinder body 17 and the front cylinder body 1, should less than that defined by the inner edges of the rear wall sound passing holes 4 of the front cylinder body. If the diameter of the rear cylinder body 17 is intended to be longer than that defined by the inner edges of the rear wall sound passing holes 4 of the front cylinder body, it is preferable that the diameter of the rear cylinder body 17 become longer than that defined by the inner edges of the rear wall sound passing holes 4 of the front cylinder body in a section thereof away from the rear wall of the front cylinder body, such as 2 mm.

The oscillating membrane 9 can be made of films of FEP50A or polyester according to whether the oscillating membrane 9 is made as an electrode and according to the oscillating performance of the oscillating membrane. The thickness of the oscillating membrane 9 can be determined by means of experiments, being equal to, thicker than, or thinner than 12.5 $\mu$m. If the oscillating membrane 9 is not made as an electrode, the electret 11 can be provided on the back electrode sheet 12. The front cylinder body 1, the front cover 2, and the fixing in place means 18 can be made of metal materials such as stainless steel, copper or aluminum, or be made of non-metal materials such as plastics. The other parts of the pickup according to the present invention can have the structure and used materials of every conventional the first-order or the second-order pressure gradient air-conduction noise canceling pickups with the so called heart shape directional performance or figure "8" type directional performance. The front cylinder body 1, the front cover 2, the rear cylinder body 17, and the rear cover 19 can be manufactured independently and separately, then assembled together as the accompany drawings. In fact, the front cylinder body 1 and the front cover 2 can be made integrally, and the rear cylinder body 17 and the rear cover 19 can also be made integrally, then the two integrated portions can be assembled together. Similarly, the inner elements can be manufactured independently and separately, then assembled together. In another way, some elements can be made integrally, the other elements can also be made integrally, then the two integrated portions can be assembled together.

The Second Embodiment

Figure 2A:
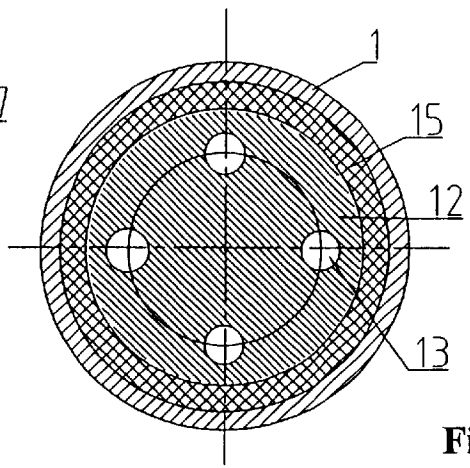
FIGS. 2A to 2C are the cross section views in lines A—A, B—B, and C—C as shown in FIG. 2, respectively.
Figure 2:
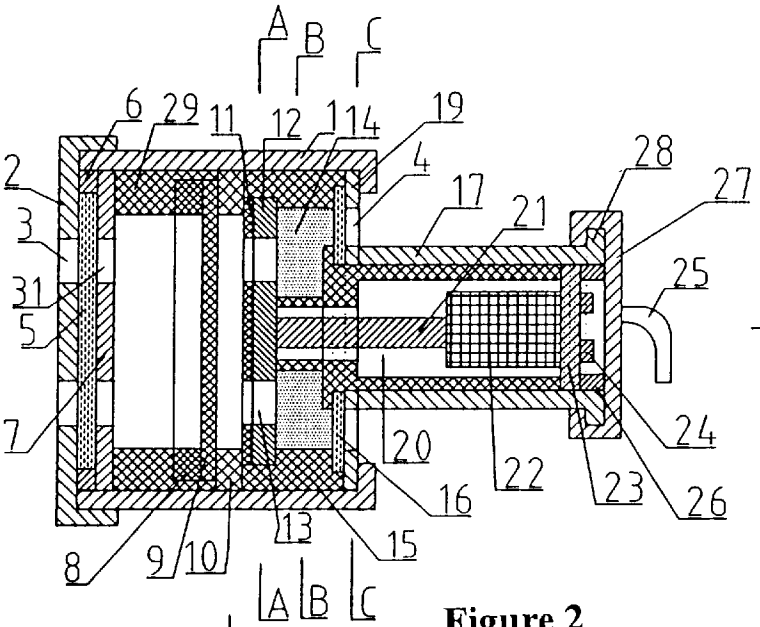
FIG. 2 is a cross section view of the noise-canceling pickup according to the second embodiment of the present invention.
Figure 2B:
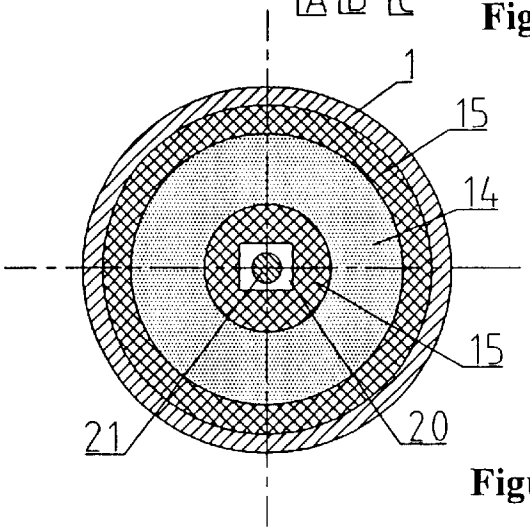
Figure 2C:
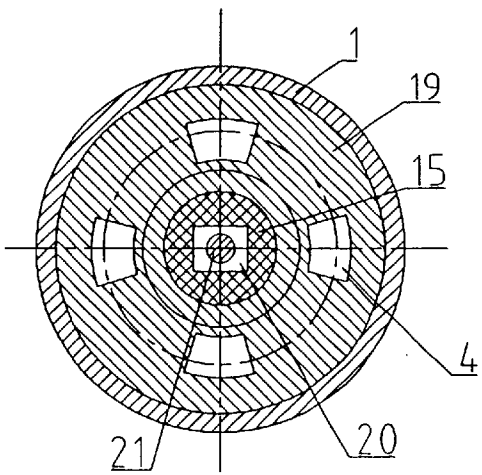

FIG. 2 is a cross section view of the noise-canceling pickup according to the present invention, wherein the oscillating membrane is located in the middle position of the front cover of the front cylinder body. The FIGS. 1A to 1D are the cross section views in lines A—A, B—B, C—C, and D—D as shown in FIG. 1, respectively. Compared to the embodiment as shown in the FIGS. 1A to 1D and FIG. 1, the embodiment as shown in the FIG. 2 has such a difference to the first embodiment that the membrane tightening ring 8 is provided to be more in the middle position of the front cylinder body 1 by means of adding a front washer 29 which abuts against the membrane tightening ring 8, so as to make the oscillating membrane 9 near the central position of the front cylinder body. In this way, the sound wave input from the front sound passing holes 3 can reach the oscillating membrane 9 at the same time when the sound wave input from the rear sound passing holes 4 reaches the oscillating membrane 9 with a reason that the distance from the front sound passing holes 3 to the oscillating membrane 9 and the distance from the rear sound passing holes to the oscillating membrane 9 are substantially equal to each other. As shown in the FIG. 2, the fixing in place means 18 of the first embodiment is replaced by the fixing in place means 27 and 28 according to the present embodiment. The fixing in place means 27 and 28 according to the present embodiment are arranged such that the circular rear cover 28 is engaged with the flange 27 which is provided at the rear end of the rear cylinder body 17 by bending the rear end of the rear cylinder body 17 in the radial direction and to the outside thereof. The rear end of the rear cylinder body 17 can be formed as being concave or convex from the rear cylinder body. The rear end of the rear cylinder body 17 can also be provided a concave or convex portion on any position on the outer surface thereof away from the connection of the front and rear cylinder bodies to the rear cover of the rear cylinder body 17, such as 1 mm or more, so as to mount the pickup on its support. The other technical features of the present embodiment are the same as those of the first embodiment, therefore, the description thereof is omitted.

The Third Embodiment

Figure 3A:
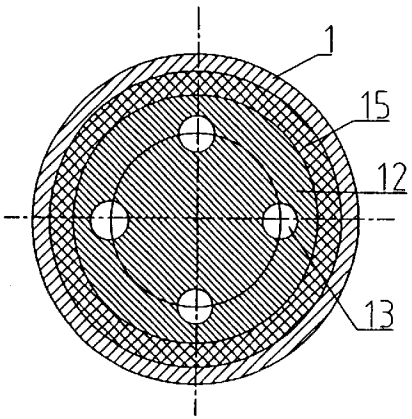
FIGS. 3A to 3C are the cross section views in lines A—A, B—B, and C—C as shown in FIG. 3, respectively.
Figure 3C:
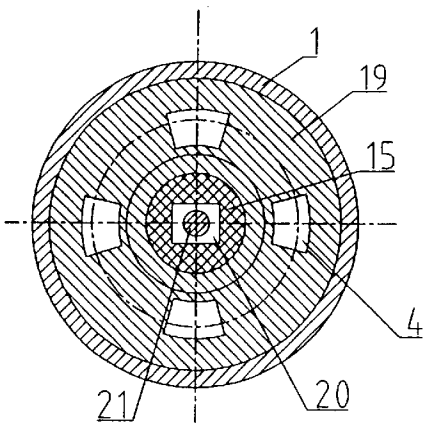
Figure 3:
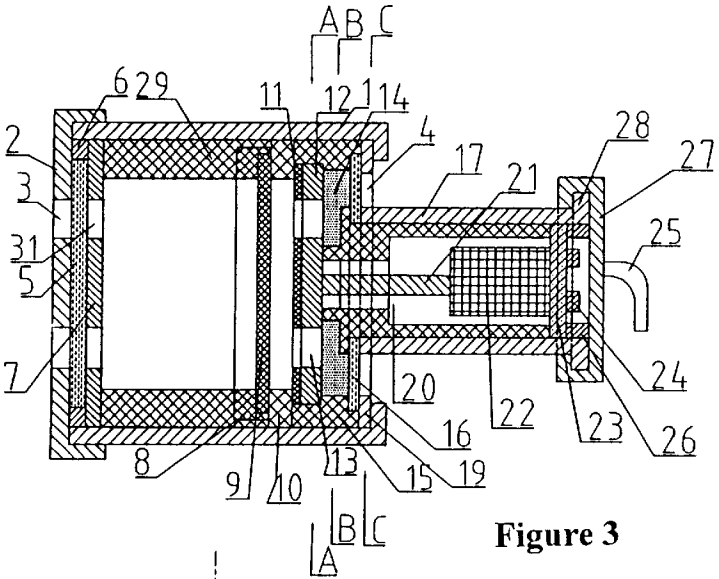
FIG. 3 is a cross section view of the noise-canceling pickup according to the third embodiment of the present invention.
Figure 3B:
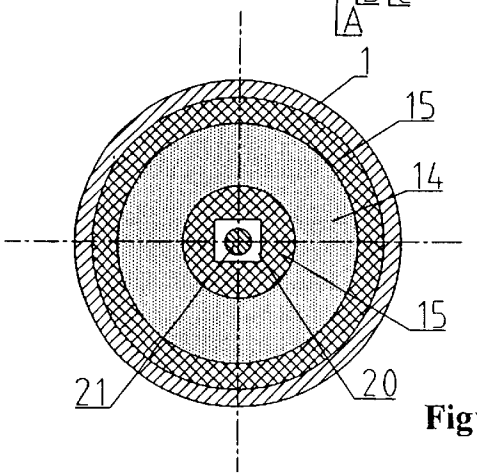

FIG. 3 is a cross section view of the noise-canceling pickup according to the present invention, wherein the oscillating membrane is located near the rear cover of the front cylinder body. The FIGS. 3A to 3C are the cross section views in lines A—A, B—B, and C—C as shown in FIG. 3, respectively. In fact, the location of the oscillating membrane 9 in the front cylinder body can be determined as the practical needs. For example, the location of the oscillating membrane 9 in the front cylinder body can be provided near the rear sound passing holes 4 of the front cylinder body 1, as shown in FIG. 3 and FIGS. 3A to 3C.

The difference between the present embodiment and the first embodiment is described as above. The other technical features of the present embodiment are the same as those of the first embodiment, therefore, the description thereof is omitted.

The Fourth Embodiment

Figure 4A:
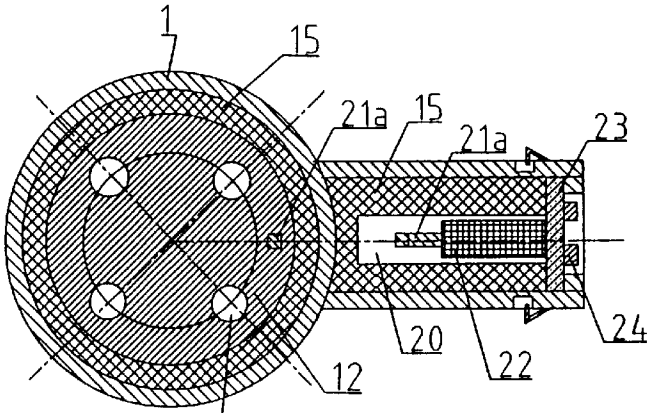
FIGS. 4A to 4C are the cross section views in lines A—A, B—B, and C—C as shown in FIG. 4, respectively.
Figure 4C:
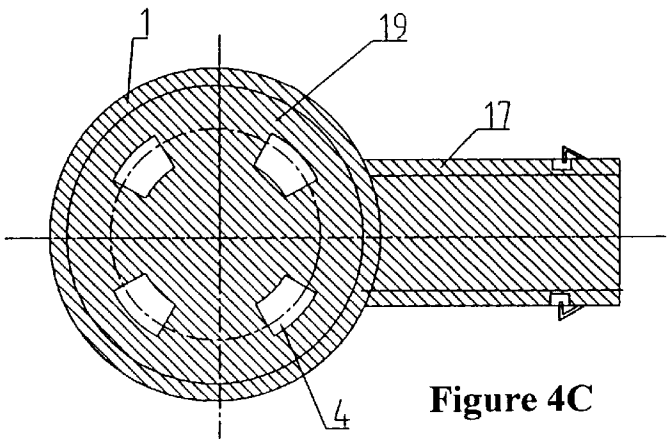
Figure 4:
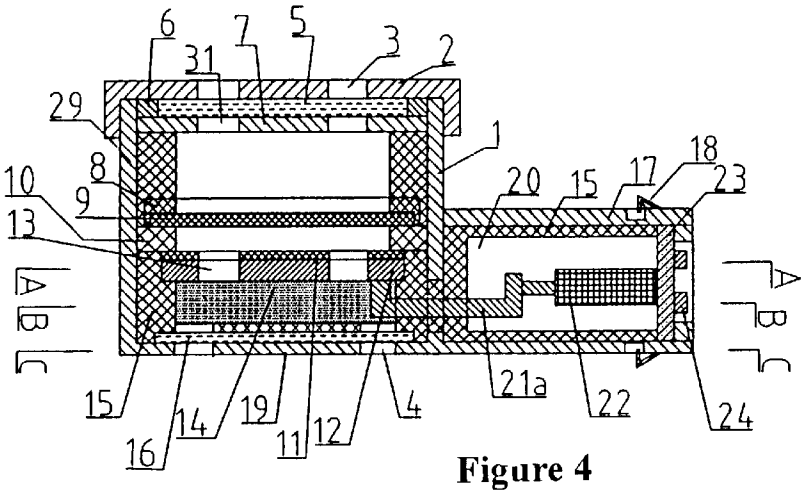
FIG. 4 is a cross section view of the noise-canceling pickup according to the fourth embodiment of the present invention.
Figure 4B:
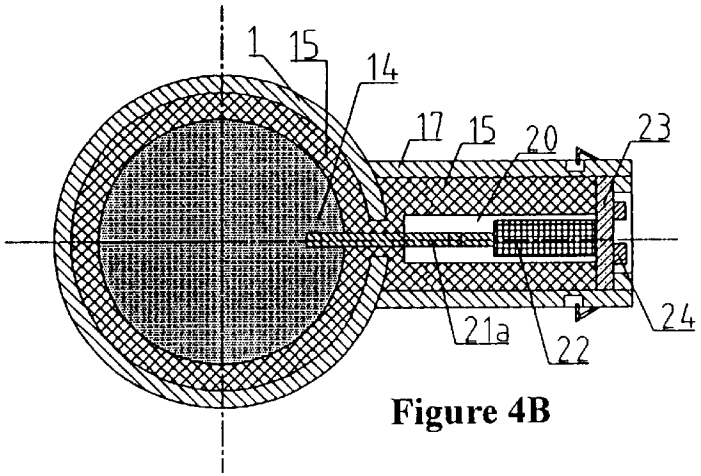

FIG. 4 is a cross section view of the noise-canceling pickup according to the present invention, wherein the rear cylinder body is provided on one side of the front cylinder body. The FIGS. 4A to 4C are the cross section views in lines A—A, B—B, and C—C as shown in FIG. 4, respectively. Compared to the embodiments as shown in the FIGS. 1 to 3, the embodiment as shown in the FIG. 4 and FIGS. 4A to 4C has such a difference to the first embodiment that the rear cylinder body 17 is provided on one side wall of the front cylinder body 1, the back electrode 21 is output from one side wall of the front cylinder body 1 in stead of being output from the rear cover 19 of the front cylinder body 1. The length, width and height of the rear cylinder body 17 can be provided to be longer than, equal to, or shorter than those of the front cylinder body 1. The shape of the rear cylinder body 17 in connection of the front and rear cylinder bodies can be formed same as, or different to that of the rear cylinder body 17 where is away from the front cylinder body. Moreover, the volume and wall thickness of the rear cylinder body 17 and the front cylinder body 1 can be modified as the practical needs. The back electrode 21*a* can be output from the rear cover 19 of the front cylinder body 1, from one side wall of the front cylinder body 1, or from the other positions such as the front cover 2 as the practical needs. Moreover, the back electrode 21*a* can be used as wiring connection electrode 24 for outputting signals from the circuits provided in the front cylinder body 1. The position and angle orientation of the rear cylinder body 17 with respective to those of the front cylinder body 1 can be regulated as the practical needs. The angle between the rear cylinder body 17 and the front cylinder body 1 can be in any suitable value. That is to say, The angle between the orientation of the end of the rear cylinder body 17 and the axis orientation of the front cylinder body 1 can be in any suitable value. As mentioned above, the rear cylinder body 17 can be provided on one side of the front cylinder body 1, on the back of the front cylinder body 1, or on the other suitable places.

Preferably, the cross section of the rear cylinder body 17 can be formed as circular, rectangular or other combined shapes from regular shapes. Moreover, the rear cylinder body 17 can be provided with a curved portion except for the main straight cylinder portion.

If the rear cylinder body 17 is not used, the output electrode or the back electrode 21*a* can be output from one side wall of the front cylinder body 1 as the practical needs, so that the thickness of the outer shell of the front cylinder body 1 can be made thinner.

The other technical features of the present embodiment are the same as those of the first embodiment, therefore, the description thereof is omitted.

The Fifth Embodiment

Figure 5A:
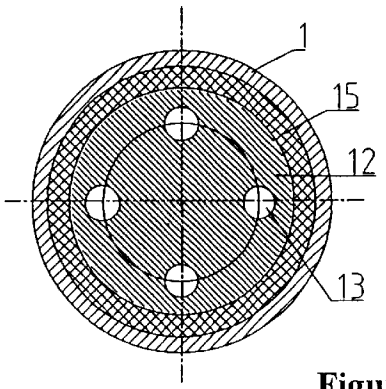
FIGS. 5A to 5C are the cross section views in lines A—A, B—B, and C—C as shown in FIG. 5, respectively.
Figure 5C:
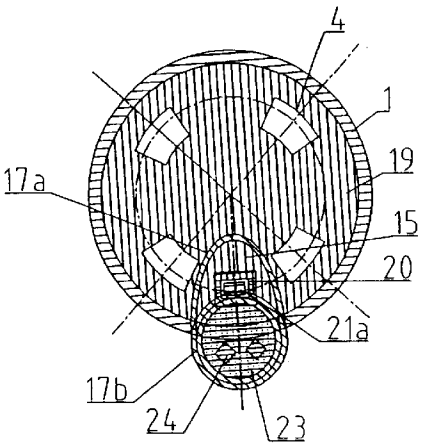
Figure 5:
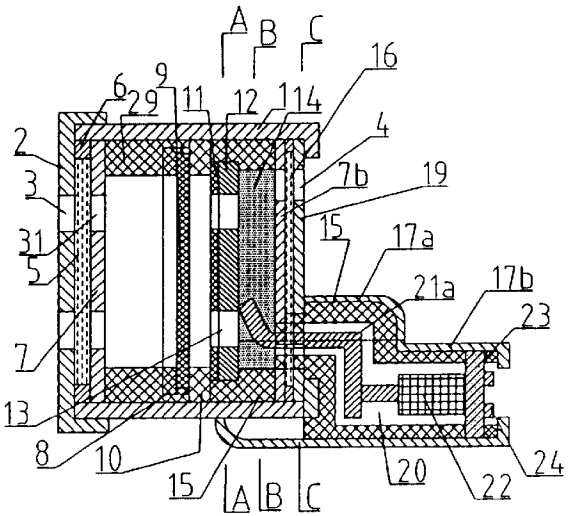
FIG. 5 is a cross section view of the noise-canceling pickup according to the fifth embodiment of the present invention.
Figure 5B:
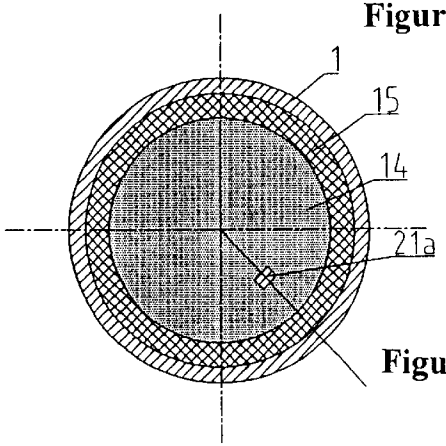

FIG. 5 is a cross section view of the noise-canceling pickup according to the present invention, wherein the rear cylinder body is provided on a position near one side wall and on the rear cover of the front cylinder body. The FIGS. 5A to 5C are the cross section views in lines A—A, B—B, and C—C as shown in FIG. 5, respectively. Compared to the embodiment as shown in the FIG. 4, the embodiment as shown in the FIG. 5 and FIGS. 5A to 5C has such a difference to the fourth embodiments that the rear cylinder body 17 is divided into a front body 17*a* and a rear body 17*b*. The front body 17*a* is provided between two of the sound passing holes 4 provided on the rear cover 19. Some part of the front body 17*a* can be arranged inside the side surface of the rear cover 19. The other part of the front body 17*a* can be arranged outside the side surface of the rear cover 19. The front body 17*a* can be formed as a half-oval shape or other suitable shapes. The rear body 17*b* can be formed as a cylinder or other suitable shapes. Some part of the rear body 17*b* can be arranged within the rear cover 4 and connected to the front body 17*a*. The other part of the rear body 17*b* is arranged outside the side surface of the front cylinder body 1 and connected to the side wall thereof. Moreover, the rear body 17*b* can be provided on the other suitable places, such as being arranged on the front cylinder body 1, but being connected to the front body 17*a* instead of the front cylinder body 1. The position and angle orientation of the rear cylinder body 17 with respective to those of the front cylinder body 1 can be regulated as the practical needs. The angle between the rear cylinder body 17 and the front cylinder body 1 can be in any suitable values. The rear body 17*b* can be composed by one or more parts, such as a front body 17*a* and a rear body 17*b*. The cross section of the front body 17*a* and the rear body 17*b* can be formed as circular, rectangular or other combined shapes from regular shapes. Moreover, the rear cylinder body 17 can be provided with a curved portion except for the main straight cylinder portion. The front body 17*a* and the rear body 17*b* can be formed as any shapes and can be provided on any positions as long as they do not prevent the sound wave from entering the rear sound passing holes provided on the rear cover of the front cylinder body 1. Moreover, the end of the rear cylinder body 17 can be provided on any orientation with respective to that of the front cylinder body 1 as the practical needs.

The other technical features of the present embodiment are the same as those of the fourth embodiment, therefore, the description thereof is omitted.

The Sixth Embodiment

Figure 6A:
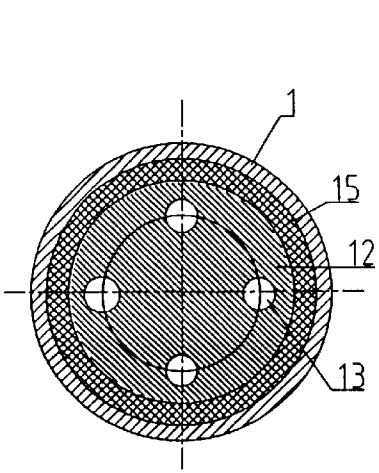
FIGS. 6A to 6D are the cross section views in lines A—A, B—B, and C—C as well as a right side view as shown in FIG. 6, respectively.
Figure 6D:
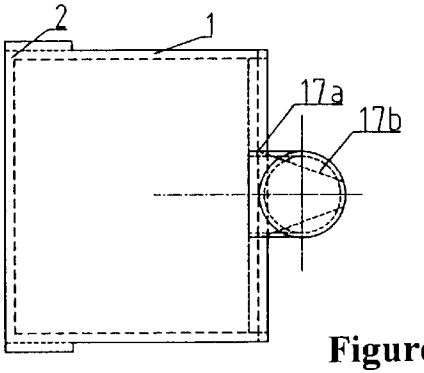
Figure 6C:
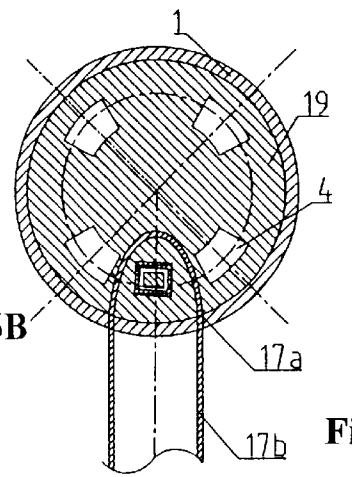
Figure 6:
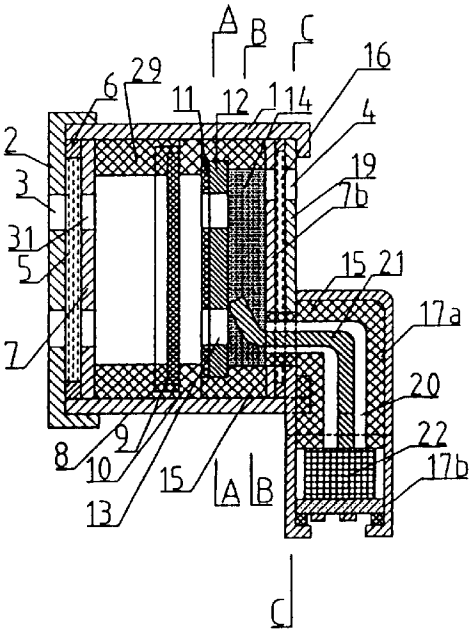
FIG. 6 is a cross section view of the noise-canceling pickup according to the sixth embodiment of the present invention.
Figure 6B:
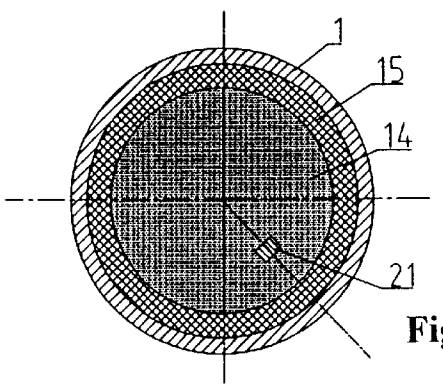

FIG. 6 is a cross section view of the noise-canceling pickup according to the present invention, wherein the rear cylinder body is provided on the rear cover of the front cylinder body. The FIGS. 6A to 6D are the cross section views in lines A—A, B—B, and C—C as shown in FIG. 6, respectively. Compared to the embodiments as shown in the FIGS. 1 to 5, the embodiment as shown in the FIG. 65 and FIGS. 6A to 6D has such a difference to the those embodiments that the orientation of the front body 17*a* is different from the orientation of the rear body 17*b*. A certain angle is arranged between the orientation of the rear body 17*b* and the axle of the front cylinder body 1, such as a right angle, and the orientation of the rear body 17*b* and the orientation of the front body 17*a* as well as the angle of the rear cylinder body 17 with respective to that of the front cylinder body 1 can be regulated as the practical needs.

The other technical features of the present embodiment are the same as those of the fifth embodiment, therefore, the description thereof is omitted.

The Seventh Embodiment

Figure 7:
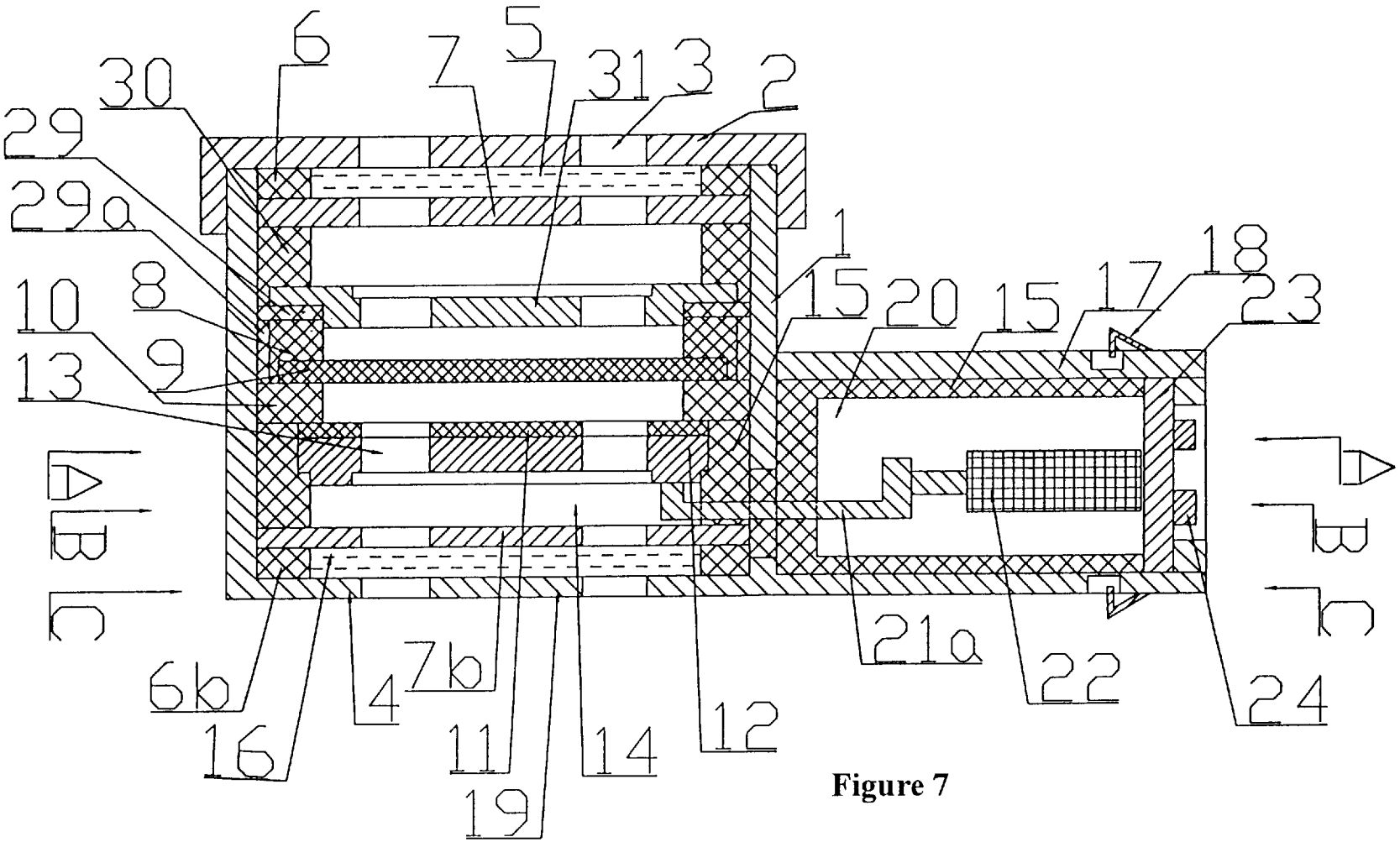
FIG. 7 is a cross section view of the noise-canceling pickup according to the seventh embodiment of the present invention.
Figure 7A:
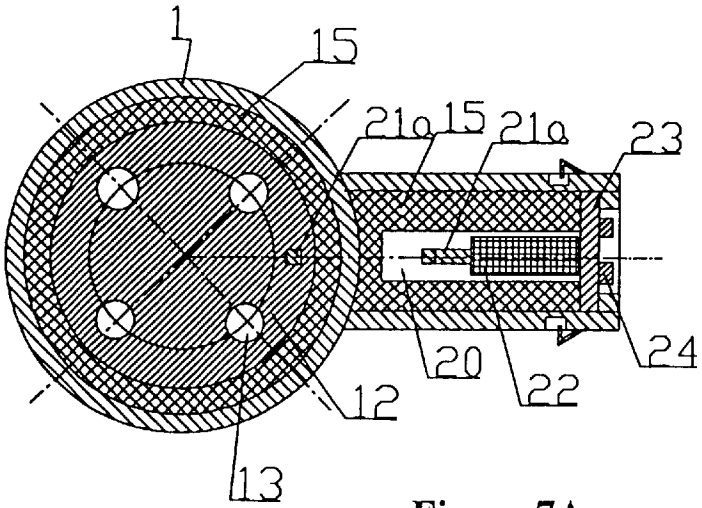
FIGS. 7A, 7B and 7C are the cross section views in lines A—A, B—B, and C—C as shown in FIG. 7, respectively.
Figure 7C:
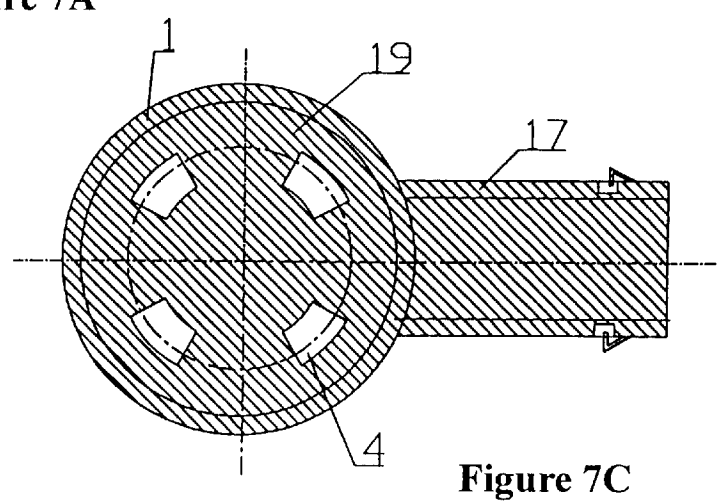
Figure 7B:
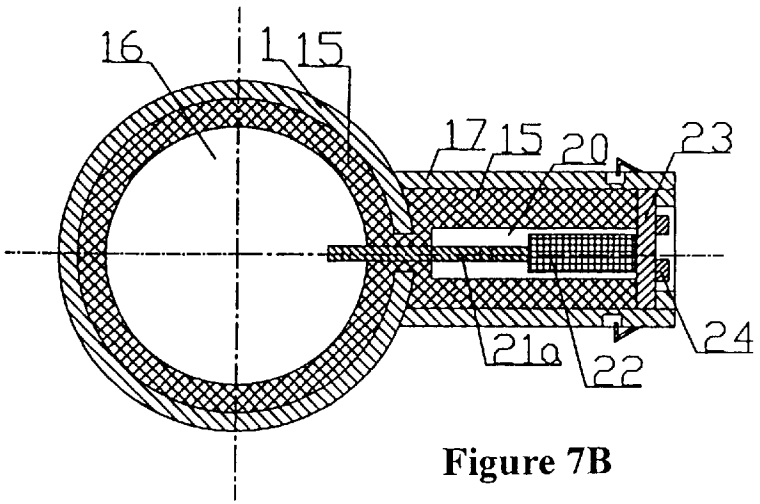

FIG. 7 is a cross section view of the noise-canceling pickup according to the present invention, wherein the rear cylinder body is located on the rear cover of the front cylinder body. The FIGS. 7A to 7C are the cross section views in lines A—A, B—B, and C—C as shown in FIG. 7, respectively. Compared to the embodiments as shown in the FIGS. 1 to 6, the embodiment as shown in the FIG. 7 and FIGS. 7A to 7C has such a difference to the those embodiments that the oscillating membrane 9 which abuts against the front washer 29 and the membrane tightening ring 8 is arranged in the middle position along the axis of the front cylinder body. However, the oscillating membrane 9 can also be arranged near the front cover or the rear cover along the axis of the front cylinder body as the practical needs. A partition 31 which is convex in the central portion thereof is arranged inside the front washer 29 provided in front of the membrane tightening ring 8, the side-front washer 29*a* and the partition washer 30. Further, the central portion of the partition 31 which is convex in shape is projected into the membrane tightening ring 8. Further, the outer surface of the central portion is arranged to abut against the inner surface of the front washer 29 and the membrane tightening ring 8, so as to form a chamber together with the oscillating membrane 9. In this way, the rear surface of the partition 31 can be arranged to proximate to but not contact with the front surface of the oscillating membrane 9. The distance from the rear surface of the partition 31 to the front surface of the oscillating membrane 9 can be arranged to be substantially equal to the distance from the rear surface of the oscillating membrane 9 to the front surface of the back electrode sheet 12. Generally, the distance from the rear surface of the partition 31 to the front surface of the oscillating membrane 9 should be determined according to the acoustic performance of the front and rear sides of the oscillating membrane 9. In this way, the time needed for the sound wave input from the front sound passing holes 3 to reach the front surface of the oscillating membrane 9 can be equal to the time needed for the sound wave input from the rear sound passing holes 4 to reach the rear surface of the oscillating membrane 9, so as to make the acoustic performances of the front and rear sides of the oscillating membrane 9 to be substantially the same as each other. The partition 31 can be made of conductive metals or non-conductive non-metals as the practical needs. If the partition 31 is made of conductive metals as the practical needs, an insulate film can be provided between the convex portion of the partition 31 and the membrane tightening ring 8, so as to prevent the convex portion of the partition 31 from electrically contact with the inner surface of the membrane tightening ring 8. At the same time, the film can be used to prevent any gap occurred between the contact surfaces of the convex portion of the partition 31 and the membrane tightening ring 8. The thickness of the convex portion of the partition 31 can be made to be equal to that of the back electrode sheet 12 as the practical needs. In order to make the thickness of the convex portion of the partition 31 to be substantially equal to that of the back electrode sheet 12, the front surface of the partition 31 can be made as a plane or as a convex or concave surface with respect to the oscillating membrane 9. The shape and the thickness of the back electrode sheet 12 can be regulated in order to make the acoustic performances of the two sides of the oscillating membrane 9 to be substantially the same as each other. For example, the shape of the back surface of the back electrode sheet 12 oriented to the rear cover can be made similar to the shape of the front surface of the back electrode sheet 12 oriented to the front cover, and the thickness of the back electrode sheet 12 can be made proximate to that of the partition 31, etc.

The front washer 29 and the side-front washer 29*a* can be used or not used as the practical needs. The front washer 29 and the side-front washer 29*a* can be designed to be integrated with or separated from each other. In order to realize the so-called heart shape directional performance, the sound space 14 provided between the back electrode base 21 and the damping membrane pressing sheet 7*b* can be filled with a damping membrane which can be the sound wave damping material A, and the chamber provided between the damping membrane pressing sheet 7*a* and the rear cover can be filled with a damping membrane 16 which can be the sound wave damping material B. If the damping membrane 16 is not used, the damping membrane pressing sheet 7*b* can also not be used. One or more sound passing holes can be provided on the partition 31, the damping membrane pressing sheet 7 and the back electrode sheet 12. The number of sound passing holes provided on one member can be the same as or not the same as that of sound passing holes provided on another member. The locations of the sound passing holes can be determined as the practical needs. The locations of the sound passing holes provided on one member can be arranged to be corresponding to or not corresponding to the locations of the sound passing holes provided on another member, respectively.

The other technical features of the present embodiment are same as those of the first to the sixth embodiments, therefore, the description thereof is omitted.

The Eighth Embodiment

Figure 8:
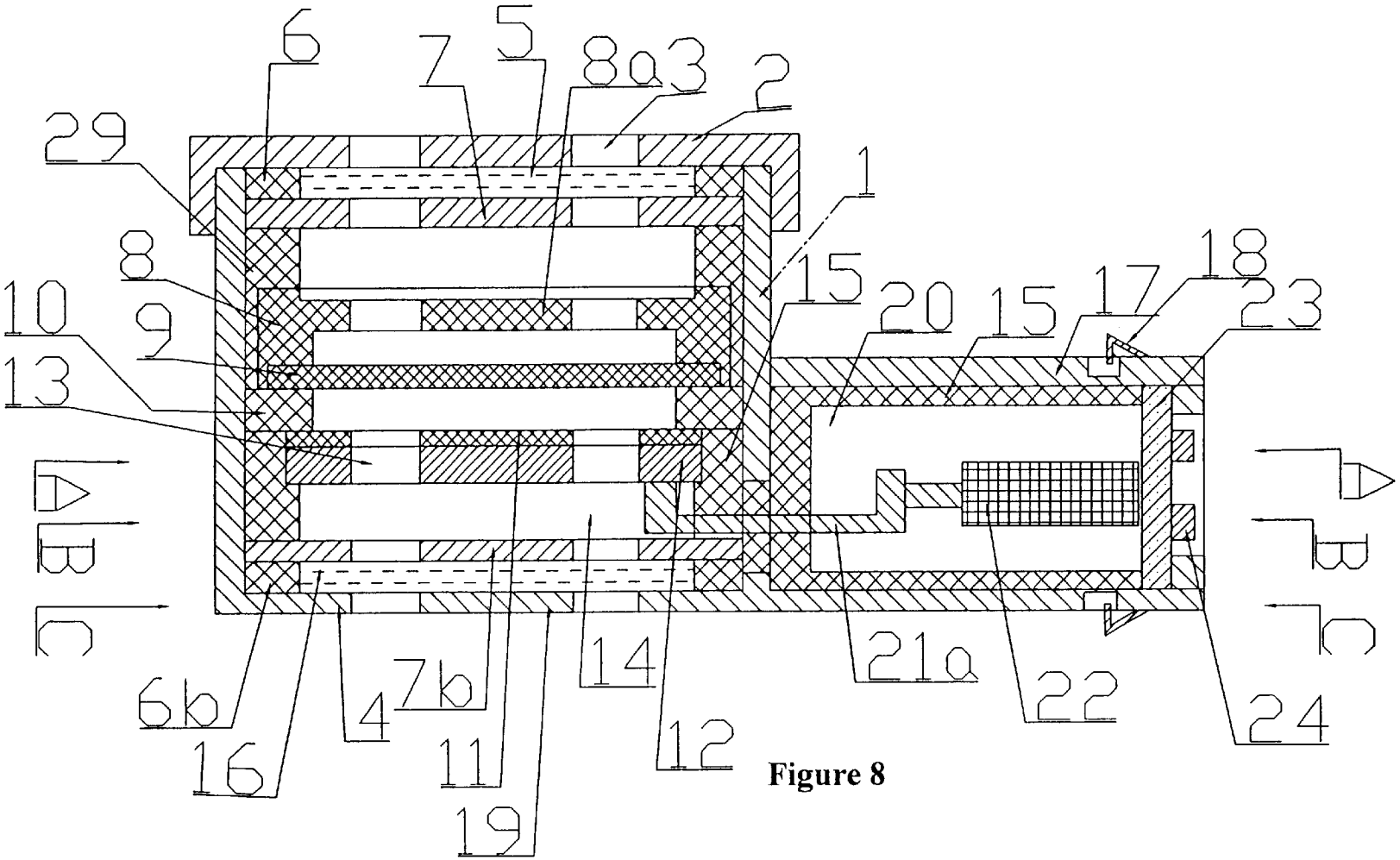
FIG. 8 is a cross section view of the noise-canceling pickup according to the eighth embodiment of the present invention.
Figure 8A:
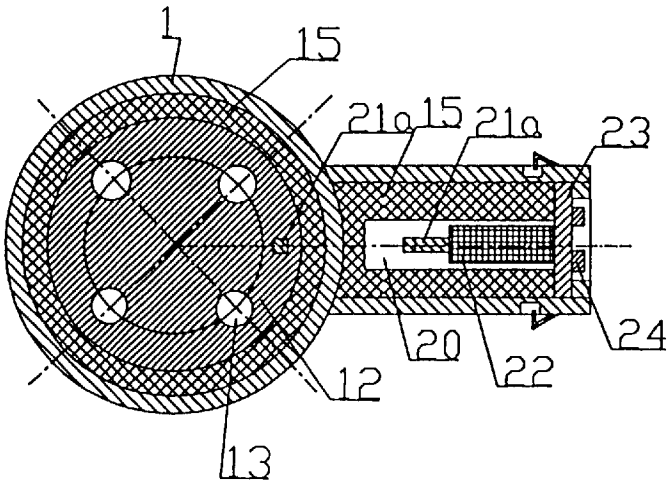
FIGS. 8A to 8C are the cross section views in lines A—A, B—B, and C—C as shown in FIG. 7, respectively.
Figure 8B:
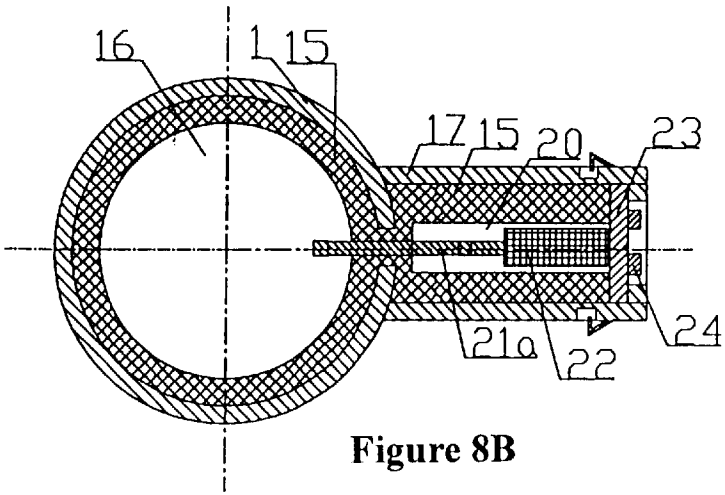
Figure 8C:
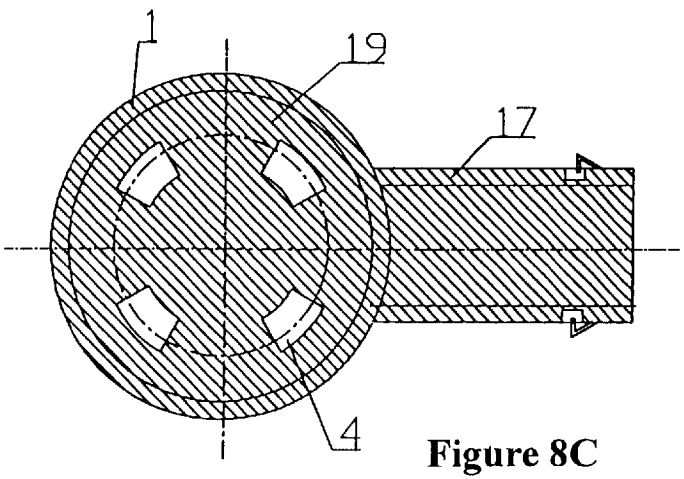

FIG. 8 is a cross section view of the noise-canceling pickup according to the eighth embodiment of the present invention. The FIGS. 8A to 8C are the cross section views in lines A—A, B—B, and C—C as shown in FIG. 8, respectively. Compared to the embodiments as shown in the FIGS. 1 to 7, the embodiment as shown in the FIG. 8 and FIGS. 8A to 8C has such a difference to the those embodiments that the oscillating membrane 9 which abuts against the front washer 29 and the membrane tightening ring 8 is arranged in the middle position along the axis of the front cylinder body. However, the oscillating membrane 9 can also be arranged near the front cover or the rear cover along the axis of the front cylinder body as the practical needs. The membrane tightening ring 8 is not in a ring shape but in a shape of a disc with a concave portion 8*a* in the central portion thereof. A chamber is formed between the concave portion 8*a* and the oscillating membrane 9. In this case, a certain distance is maintained between the rear surface of the concave portion 8*a* and the front surface of the oscillating membrane 9. The distance from the rear surface of the concave portion 8*a* to the front surface of the oscillating membrane 9 can be arranged to be substantially equal to the distance from the rear surface of the oscillating membrane 9 to the front surface of the back electrode sheet 12, preferably being determined according to the acoustic performance of the front and rear sides of the oscillating membrane 9. In this way, the time needed for the sound wave input from the front sound passing holes 3 to reach the front surface of the oscillating membrane 9 can be equal to the time needed for the sound wave input from the rear sound passing holes 4 to reach the rear surface of the oscillating membrane 9, so as to make the acoustic performances of the front and rear sides of the oscillating membrane 9 to be substantially the same as each other. The concave portion 8*a* can be made of conductive metals or non-conductive non-metals as the practical needs, using the material being same as or different to the material used to make the membrane tightening ring 8. The thickness of the concave portion 8*a* can be made to be substantially equal to that of the back electrode sheet 12 as the practical needs. In order to make the thickness of the concave portion 8*a* to be substantially equal to that of the back electrode sheet 12, the front surface of the concave portion 8*a*can be made as a plane or other suitable surfaces such as a convex or concave surface with respect to the oscillating membrane 9.

One or more sound passing holes can be provided on the membrane tightening ring 8, the damping membrane pressing sheet 7 and the back electrode sheet 12. The number of sound passing holes provided on one member can be arranged to be the same as or not the same as that of sound passing holes provided on another member. The locations of the sound passing holes can be determined as the practical needs. The locations of the sound passing holes provided on one member can be arranged to be corresponding to or not corresponding to the locations of the sound passing holes provided on another member, respectively.

The other technical features of the present embodiment are same as those of the first to the seventh embodiments, therefore, the description thereof is omitted.

Further, other new embodiments can be established by recombining every parts listed in the above preferably embodiments of the present invention. For example, the front cylinder body and the rear cylinder body as shown in the accompany drawings can be interchanged with each other, or the components provided in the front cylinder body can be interchanged with the components provided in the rear cylinder body.

The technical solution of the noise-canceling pickup according to the present invention not only can be used to the pickup with an electret, but also can be used any other types of pickups such as the moving-coil pickup, the electromagnetic-type pickup, the ceramic pickup or the semiconductor pickup.

INDUSTRIAL APPLICABILITY

According to the noise-canceling pickup of the present invention, it is even active on the higher frequency band, and of good effect for noise-canceling with the benefit from the short distance between the opposite front and rear sound passing holes. With these merits, even if in the case of the ambient noise is relatively strong, it is capable to input the voice to be identified by the computer. In the way, the voice input work does not need to be done in the special language laboratory. It is also sensitive enough to cancel the noise in the pickup used in the communication device.

According to the noise-canceling pickup of the present invention, it can be mounted onto its external supports without the outer shell. With this case, simple structure, small volume and low cost are all realized for the noise-canceling pickup of the present invention.

While the invention has been explained by detailed descriptions of the preferred embodiments in connection with the accompany drawings as stated above, it is understood for those skilled in the art that various improvements, modifications and substitutions to the noise-canceling pickup of the present invention can be made in the hints contained in the preferred embodiments within the spirits and the scope of the present invention which is only defined by the appended claims.

What is claimed is:

1. A noise canceling pickup with an electret, comprising a cylinder body having a front cover and a rear cover, said front cover is provided with sound passing holes, said cylinder body is provided with an oscillating membrane of the electret, a back electrode sheet and a back electrode base, characterized in that said cylinder body is composed of a front cylinder body and a rear cylinder body, said oscillating membrane is provided into said front cylinder body, a membrane tightening ring is provided to abut against the oscillating membrane so as to adjust the position of the oscillating membrane, a damping membrane is provided within said front cylinder body to abut against the front cover thereof, said damping membrane is fixed by a damping membrane pressing sheet, said rear cover of said cylinder body is provided with at least one sound passing hole, and said rear cylinder body is provided with electric elements therein, wherein said front cylinder body is provided with a partition washer which is in engagement with the damping membrane pressing sheet, a side-front washer which is in engagement with the membrane tightening ring, and a partition which is convex in the central portion thereof and is provided between said partition washer and side side-front washer, said central portion of the partition is arranged to convex to the oscillating membrane and to be projected into the membrane tightening ring, so as to form a chamber together with the oscillating membrane, and the outer surface of said convex portion is arranged to abut against the inner surface of said side-front washer and the inner surface of said membrane tightening ring.

2. A noise canceling pickup with an electret as claimed in claim 1, characterized in that said damping membrane is arranged in the middle position of said front cylinder body.

3. A noise canceling pickup with an electret as claimed in claim 1, characterized in that said damping membrane is arranged within said front cylinder body to abut against the rear cover wall thereof.

4. A noise canceling pickup with an electret as claimed in claim 1, characterized in that the cross section of said rear cylinder body is different to from that of said front cylinder body, a connection portion between the rear cylinder body and the front cylinder body is formed so as to not prevent the sound wave from entering the sound passing hole of the rear cover of the front cylinder body.

5. A noise canceling pickup with an electret as claimed in claim 4, characterized in that said rear cylinder body is connected to the back surface or side surface of said front cylinder body.

6. A noise canceling pickup with an electret as claimed in the claim 5, characterized in that said rear cylinder body is combined with a front body and a rear body, a certain angle is arranged between the orientation of said front body and that of said rear body.

7. A noise canceling pickup with an electret as claimed in the claim 5, characterized in that said back electrode is output from a side wall of said front cylinder body.

8. A noise canceling pickup with an electret as claimed in claim 1, further comprising a fixing in place means which is provided on said rear cylinder body.

9. A noise canceling pickup comprising:

a front cylinder body having a front cover with a first sound passing hole and a rear cover with a second sound passing hole;

a back electrode sheet, a back electrode base, and an oscillating membrane placed in the front cylinder body;

a membrane tightening ring engaging with the oscillating membrane a side-front washer engaging with the membrane tightening ring;

a first damping membrane abutting against the front cover;

a second damping membrane abutting against the rear cover;

a rear cylinder body coupled to the front cylinder body, the rear cylinder body having a field-effect tube, a printed circuit board and a wiring electrode provided therein acid a damping pressing sheet adjacent to the first damping membrane and engaging with the side-front washer.

10. A noise canceling pickup as claimed in claim 9, wherein the oscillating membrane is made as an electrode.

11. A noise canceling pickup as claimed in claim 9, further comprising an electret provided on the back electrode sheet.

* * * * *